US012667142B2

(12) United States Patent
Harrington

(10) Patent No.: US 12,667,142 B2
(45) Date of Patent: Jun. 30, 2026

(54) MODESTY-PRESERVING BOTTOMS

(71) Applicant: Brittany Harrington, Los Angeles, CA (US)

(72) Inventor: Brittany Harrington, Los Angeles, CA (US)

( * ) Notice: Subject to any disclaimer, the term of this patent is extended or adjusted under 35 U.S.C. 154(b) by 0 days.

(21) Appl. No.: 18/746,711

(22) Filed: Jun. 18, 2024

(65) Prior Publication Data

US 2025/0380752 A1 Dec. 18, 2025

(51) Int. Cl.
*A41D 7/00* (2006.01)
*A41D 31/04* (2019.01)
*A41D 31/10* (2019.01)

(52) U.S. Cl.
CPC ..... *A41D 7/005* (2013.01); *A41D 31/04* (2019.02); *A41D 31/10* (2019.02); *A41D 2500/10* (2013.01)

(58) Field of Classification Search
CPC ..... A41B 9/001; A41B 9/004; A41B 9/04; A61F 13/496; A61F 13/2057; A61F 2013/51439
See application file for complete search history.

(56) References Cited

U.S. PATENT DOCUMENTS 4,969,216 A * 11/1990 Guelli ..... A41B 9/001 2/400
5,260,345 A * 11/1993 DesMarais ..... A61F 13/535 521/905
6,406,648 B1 * 6/2002 Noel ..... C08J 9/28 521/64
2005/0137557 A1 * 6/2005 Swiecicki ..... A61F 5/455 604/385.17
2008/0276352 A1 * 11/2008 Strange ..... A41B 17/00 2/400
2010/0175171 A1 * 7/2010 Dye ..... A41B 9/04 2/406
2013/0281958 A1 * 10/2013 Back ..... A61F 13/49015 156/196
2014/0039432 A1 * 2/2014 Dunbar ..... A61F 13/15577 604/394
2016/0165959 A1 * 6/2016 Hayes ..... A41B 9/04 2/67
2021/0100698 A1 * 4/2021 Langdon ..... A61F 13/496
2022/0295926 A1 * 9/2022 Fernando ..... B32B 5/26
2023/0059401 A1 * 2/2023 Mellos ..... A61F 13/15268
2023/0082418 A1 * 3/2023 Mellos ..... B32B 5/026 2/69
2023/0338206 A1 * 10/2023 Welch ..... A41D 31/102
2023/0380513 A1 * 11/2023 Collins ..... A41B 9/04
(Continued)

*Primary Examiner* — Jillian K Pierorazio

(57) ABSTRACT

Modesty-preserving bottoms as swimwear or active wear are provided. In particular, such bottoms comprise a modesty panel immovably disposed along an inside of a crotch portion of the bottoms to smooth fabric over a wearer's genial area in order to prevent the particular shape, size, and appearance of the wearer's genitalia from being discerned through such fabric. The modesty panel may be concave, to approximate the overall shape of the wearer's genitalia, and comprise shape-retentive, molded padding such as polyfoam. Additional layers, linings, and materials may be provided on an inside of the bottoms over the modesty panel to increase air flow and wick moisture from the wearer's body as needed or desired.

13 Claims, 4 Drawing Sheets

(56) References Cited

U.S. PATENT DOCUMENTS

| | | | | |
|---|---|---|---|---|
| 2024/0032609 | A1* | 2/2024 | Power | A41D 27/02 |
| 2024/0065345 | A1* | 2/2024 | White | A41B 9/004 |
| 2024/0065901 | A1* | 2/2024 | Stanley | A61F 13/565 |

* cited by examiner

MODESTY-PRESERVING BOTTOMS

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to garments configured for modesty and, more particularly, to close-fitting swimwear, active wear, and other bottoms or briefs with fully integrated elements configured to shield certain body contours from observation through such close-fitting garments.

BACKGROUND

In recent years, there has been an increasing concern over low levels of body acceptance and poor self-image among adolescents and young adults. Efforts to improve the comfort and confidence of women in particular while wearing form fitting or minimal, but often functional, clothing such as sportswear and bathing suits have included, for instance, therapy, public service announcements, social media influencing, and even commercial marketing efforts that feature diverse body types.

In general, however, the prevalence and accessibility of social media has had an adverse effect on self-image, and many blame this for the recent rising rates of plastic surgery and other aesthetic treatments. The popularity of labiaplasty surgery, in particular, has surprisingly surged, with nearly 19,000 procedures performed in the United States in 2021, representing a 36% increase from 2020 according to the Aesthetic Plastic Surgery National Databank. Globally, 164,667 labiaplasties were performed in 2020, marking a 73% increase since 2015, as reported by the International Society of Aesthetic Plastic Surgery. Alarmingly, the number of teenage girls undergoing this procedure has also been on the rise. This trend underscores the growing societal pressure on women and girls to conform to certain aesthetic standards, which can be mitigated by offering more vulva-coverage and comfort in close-fitting bottoms.

In the context of sportswear, especially swimwear, providing garments with greater surface area coverage, such as skirted or loose-fitting modesty bathing suits and boy shorts, has not been sufficient to solve the problem. This is because, on the one hand, garments with greater coverage may not reflect the current styles and trends. In addition, however, this does not sufficiently address the problem of clinginess in close-fitting swim and sports apparel that ultimately highlights or reveals body contours associated with, for instance, prominent labia.

Some have proposed integrating fabric lining in the whole interior of one-piece swimwear in an effort to improve opacity and provide full body support through the such garments. However, this has not sufficiently addressed the issue. Body movement and water activities can cause a lining applied to close-fitting active wear to shift or bunch, disrupting the smoothness of the outer fabric over the inner fabric. If the lining is not designed to fit precisely with the outer fabric, it can create gaps or bulges that are visible through the outer layer, which not only fails to solve the problem of visible genital contours, but exacerbates it with additional, potentially uncomfortable folds that do nothing to alleviate self-consciousness over perfectly normal anatomical features. Moreover, such linings are not thick or supportive enough to provide coverage over the vulvar region for additional modesty.

Exploring alternatives to the use of additional lining, some have proposed supplying underwear with removable inserts. One such proposal appears in U.S. Pat. Pub. No. 2011/0099693 by Pratt, which teaches inserting removable pads into panties that can be worn under other formfitting clothing. However, this approach presents issues as well. For instance, removable inserts often require separate cleaning and can become uncomfortable if they shift during wear, particularly during vigorous activities like participating in sports. In the event that inserts do not need to be removed during wash, they often shift and fold and twist over themselves and must be manually adjusted before wearing again, which can be a tedious task. In addition, this disclosure does not propose any solutions for those garments, such as swimwear and sportswear that are often worn without underwear.

Thus, although various proposals have been made to solve the problems, none of those in existence combine the characteristics of the present invention. Therefore, there remains a need for swim and sportswear bottoms that conceal the particular contours of female anatomy.

SUMMARY

The present disclosure is directed to a bottom portion of a close or form-fitting swim or active-wear garment, whether formed as a standalone brief or bikini bottom, shorts, or leggings, or as part of a one-piece unitard or the like. A fully integrated modesty panel may be secured in a crotch portion of such bottom. The modesty panel may be placed and configured to smooth the form-fitting garment over a wearer's crotch and is, in particular, operative to prevent the particular shape, size, and appearance of the wearer's genitalia from being discerned through such fabric.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In an embodiment, the bottom portion may have an inside and an outside defining a first opening and a second opening as leg holes on either side of the crotch portion. A shape-retentive, concave, molded, modesty panel may be formed to approximate the general curve of a wearer's pubic region and immovably fixed along the inside crotch portion. The modesty panel may comprise one or more layers of flexible polyurethane foam ("polyfoam" or "FPF"), latex foam, silicone, power mesh or any other material known or developed as may be suitable as padding. That is, other materials are contemplated and may be utilized depending on the particular needs of the wearer. In any case, when worn and placed as described, the modesty panel will be operative to smooth fabric comprising the form-fitting bottom portion over the contours of a wearer's genital area.

As active wear, it is contemplated that the bottom portion be made of materials having some combination of the following qualities: hydrophobic and quick-drying, resistance to dye fading or running, four-way stretch to contour and hug the body, UV-resistance, UPF+ resistance, chlorine resistance, drag reduction and resistance, and compression. In some embodiments, the bottom portion may comprise any or a combination of resilient, four-way stretchable material selected from the group consisting of water-resistant elastane, polyester, polyamide, power mesh, and nylon. Such material may be configured as a knit, tricot-blend, textured jacquard knit, or rib-knit material as desired or needed depending on particular activity and/or comfort needs of the wearer.

In some embodiments, an additional lining may be secured to all or some part of the inside of the bottom portion to provide additional structure and smoothing as needed or desired. The lining may be a power mesh lining, which may be particularly beneficial when deployed with the modesty-preserving bottoms as it is a stable, washable material that does not shift significantly when worn.

It is contemplated that providing a modesty panel in a form-fitting bathing suit or sportswear bottom according to the disclosure and claims provided below, whether as part of a one-piece or separate brief or bikini bottom, shorts, may significantly enhance both physical comfort and psychological well-being for the wearer.

Thus, it is an object of the invention to discreetly and impermanently reduce the appearance of genital contours from the outside of close-fitting garments.

It is another object of the invention to reduce self-consciousness when wearing close-fitting garments.

It is still another object of the invention to reduce self-consciousness when participating in athletic activity and swimming.

It is yet another object of the invention to provide modesty-preserving activewear that can be worn without additional undergarments One or more of the above-disclosed embodiments, in addition to certain alternatives, are provided in further detail below with reference to the attached figures. The disclosed subject matter is not, however, limited to any particular embodiment disclosed.

Figure 1A:
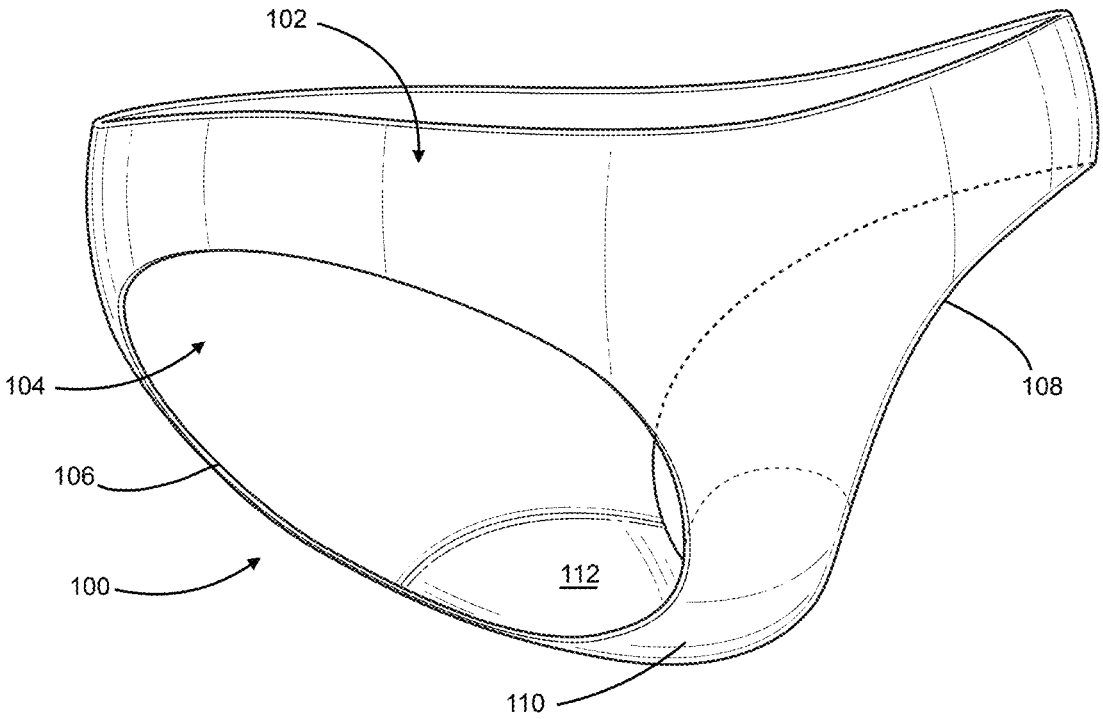
FIG. 1A shows a perspective view of an embodiment of a modesty-preserving bottom.

The disclosed embodiments may be better understood by referring to the figures in the attached drawings, as provided below. The attached figures are provided as non-limiting examples for providing an enabling description of the method and system claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

Figure 1B:
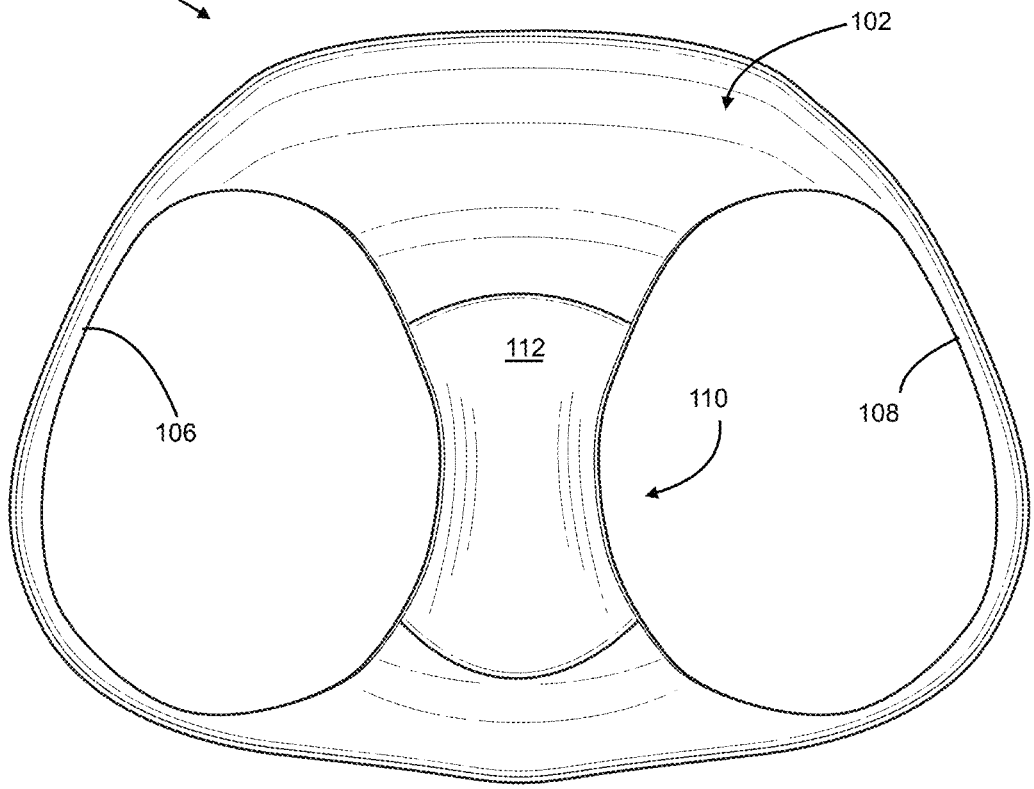
FIG. 1B shows an over-head interior view of an embodiment of a modesty-preserving bottom.

FIGS. 1A and 1B show alternative views of one exemplary modesty preserving garment as a bottom portion 100 of a close or form-fitting ladies' brief or bikini or in accordance with one embodiment of the invention. It is to be noted, however, that the bottom 100 may take various forms without departing from the invention. For instance, the bottom 100 may comprise design details not shown such as ties, imagery, and appliques; or may form a bottom portion of a one-piece bathing suit, shorts, leggings, a leotard, or even a unitard. Thus, the figures are provided by way of clarifying example only and not limitation.

Figure 5:
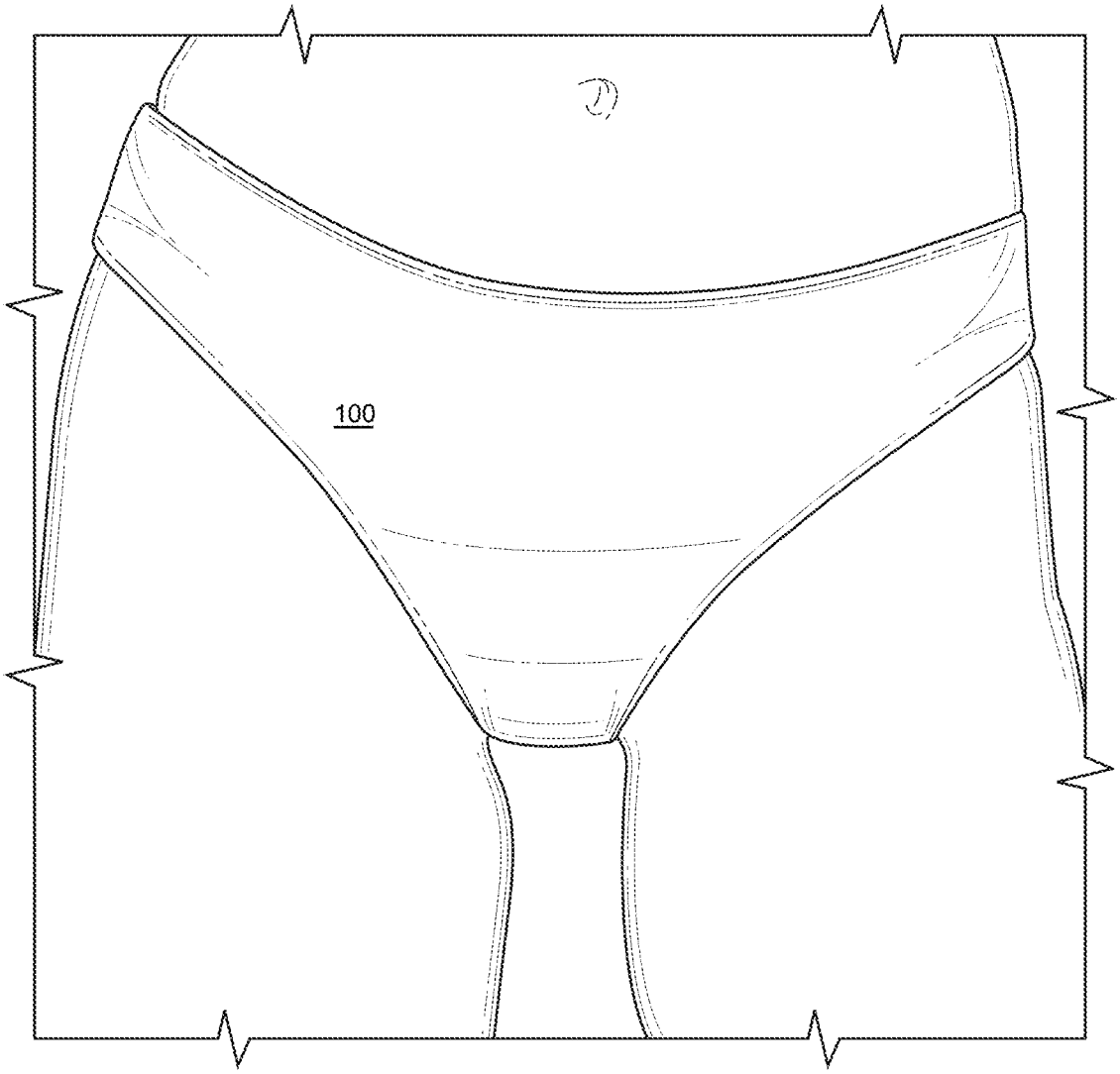
FIG. 5 shows an exemplary embodiment of a modesty-preserving bottom in use.

In one embodiment, the bottom portion 100 may have an inside 102 and an outside 104 defining a first opening 106 and a second opening 108 as leg holes on either side of a crotch portion 110. A modesty panel 112 may be formed to conform to the shape of the crotch portion 110 and secured along the inside 102 of the crotch portion 110 such as along any edges of the first and second openings 106, 108. In some embodiments, the modesty panel 112 is shape-retentive, concave, and molded to approximate the general curve of a wearer's pubic region so that, when worn, the modesty panel 112 will be operative to smooth fabric comprising the form-fitting bottom portion 100 over the contours of a wearer's genital area, as seen in FIG. 5. Indeed, with reference to FIG. 2, it may be seen that removal of the modesty panel 112 may significantly reduce structure from the crotch portion 110, making the crotch portion 110 liable to cling to and even highlight the wearer's anatomical contours.

Figure 2:
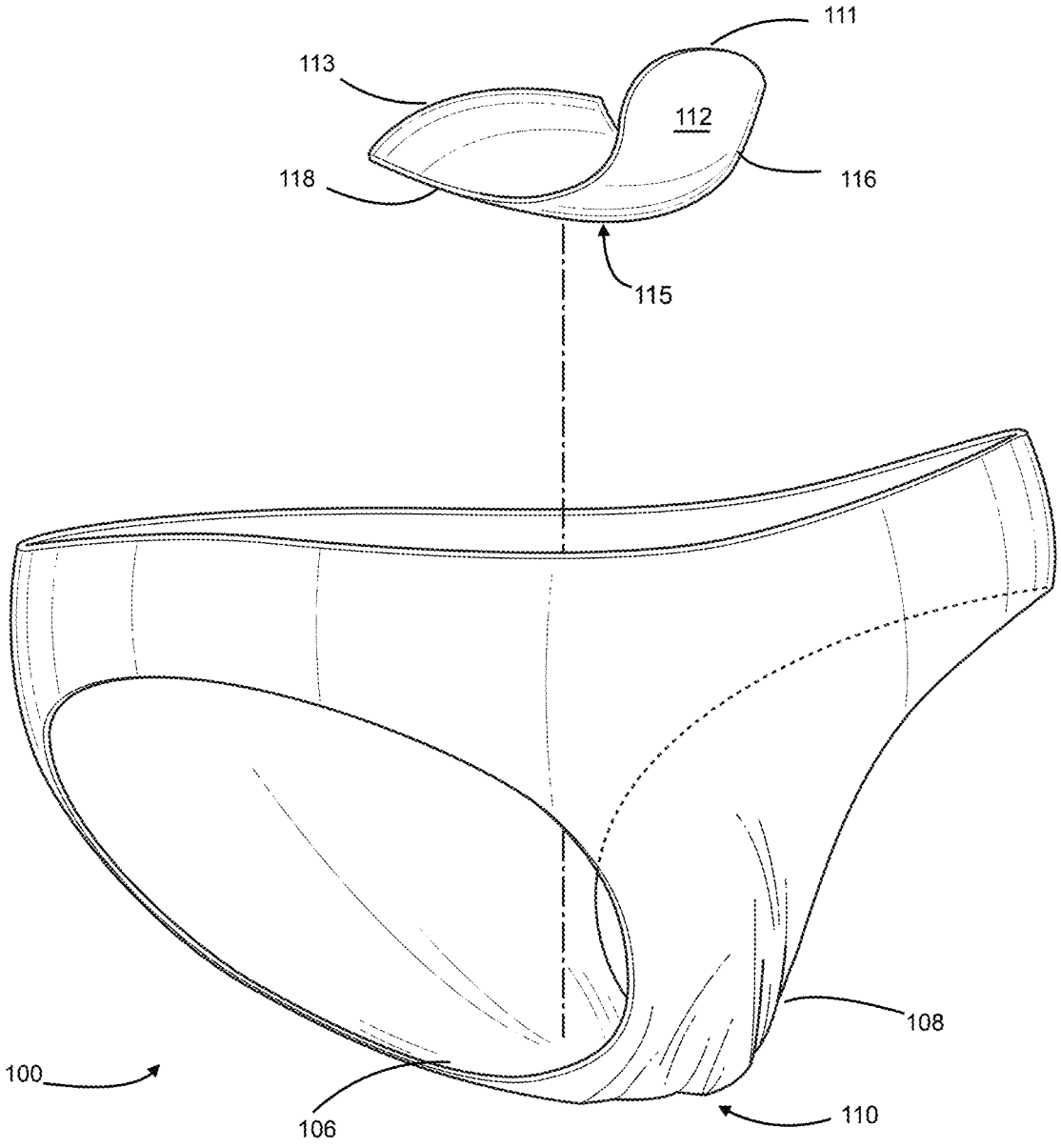
FIG. 2 shows an exploded perspective view of an embodiment of a modesty-preserving bottom.
Figure 3:
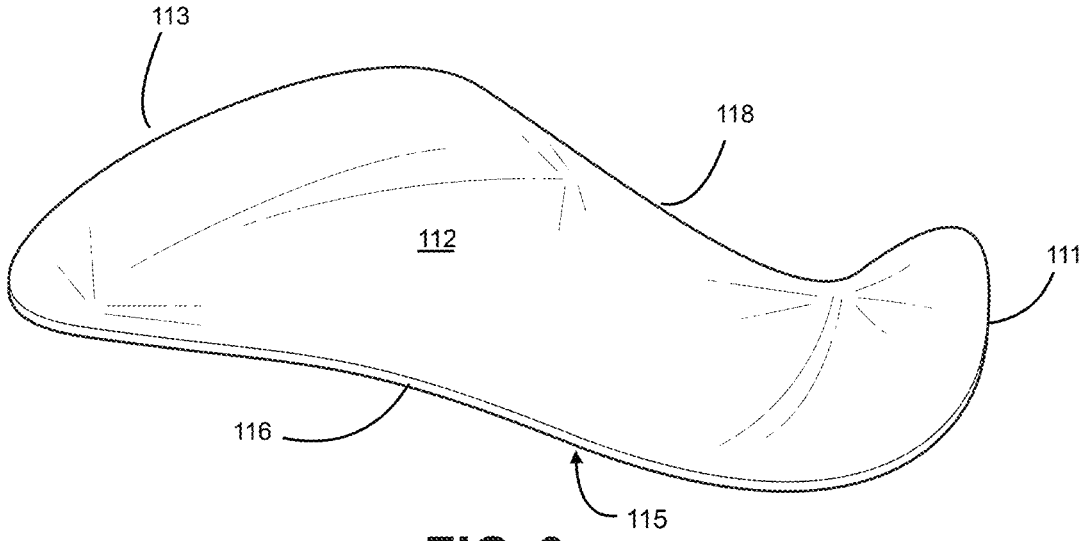
FIG. 3 shows an exemplary modesty panel in accordance with one embodiment of the invention.
Figure 4:
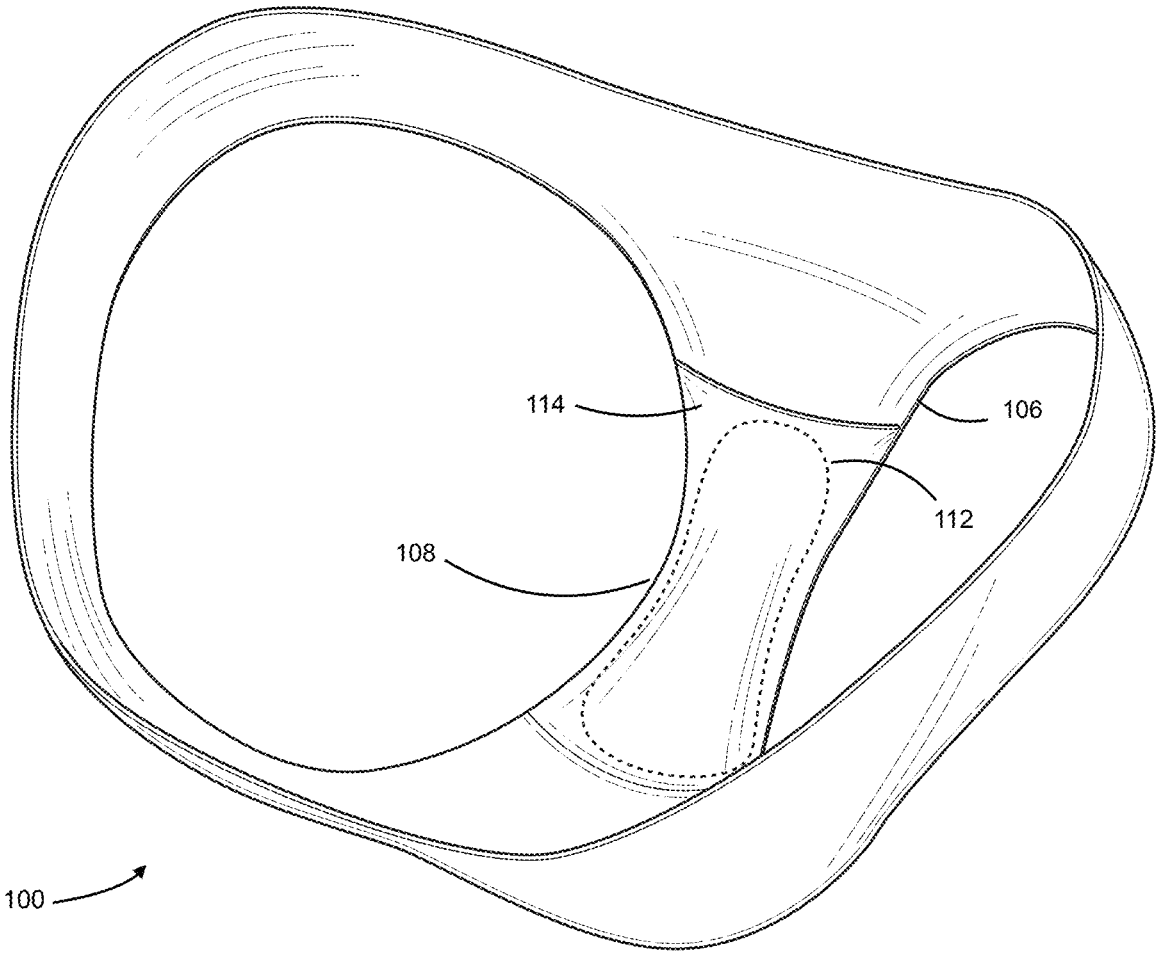
FIG. 4 shows an exemplary embodiment of a modesty-preserving bottom in accordance with one embodiment of the invention.

Turning to FIGS. 2-4, the modesty panel 112 may be defined by a front end 111 and rear end 113 as well as first and second side edges 116, 118 shaped to correspond to the crotch portion 110 of the modesty-preserving bottoms. That is, the modesty panel 112 may be placed along the inside of the bottom portion 100 such that the first end 111 is operative to conceal at least a lower portion of the wearer's mons pubis, and the rear end 113, wider than the front end 111, is operative to conceal at least a portion of the wearer's perineum. A central portion of the modesty panel 115 may be relatively thinner than the front and rear ends 111, 113 to comfortably fit between a wearer's legs and avoid interfering with leg movement. As such, the first and second side edges 116, 118 of the modesty panel 112 may be configured to abut the first and second bottom openings 106, 108. Arranging the modesty panel 112 in this manner may enable secure attachment within the bottom along the openings 106, 108 such as by stitching. In some embodiments, the entire perimeter of the modesty panel may be stitched either to the fabric comprising the form-fitting bottom portion 100 or to any additional linings as needed or desired to prevent the modesty panel 112 from shifting within the bottom portion 100.

In some embodiments, the first and second ends 111, 113 may be relatively thinner or tapered as compared to the intervening portions of the modesty panel 110 in order to further conceal the panel itself from view outside of the bottom portion 100.

The particular size of the modesty panel 112 may depend on the size of the crotch portion 110, and incidentally the bottom portion 110, to which it is applied. Of course, one will recognize that this will correspond to the size of the wearer and therefore any particular size or proportions of the modesty panel 112 are offered by way of example only. Still, it is contemplated that the modesty panel may be about 4 to about 6 inches long, in order to effectively conceal genital contours from view through the form-fitting bottoms.

The modesty panel 112 may comprise one or more layers padding as, for instance, polyfoam, latex foam, silicone, power mesh or any other material known or developed as may be suitable for this purpose. Other materials, such as nylon, polyester, polyamide, and even performance fabrics may be utilized in conjunction with the padding depending on the particular needs of the wearer such as for breathability, absorption, moisture wicking, cushioning and the like.

It is contemplated that the bottom portion 100 may comprise materials suitable for swimming and/or active wear, such as, for example only and not limitation, for gymnastics, track and field, long distance running, dance, and yoga, and further is configured to obviate any need to wear additional modesty-preserving undergarments while participating in such activities. As such, the bottom portion 100 be made of materials having some combination of the following qualities: hydrophobic and quick-drying, resistance to dye fading or running, four-way stretch to contour and hug the body, UV-resistance, UPF+ resistance, chlorine resistance, drag reduction and resistance, and compression. In some embodiments, the bottom portion 100 may therefore comprise any or a combination of resilient, four-way stretchable materials selected from the group consisting of water-resistant elastane, polyester, polyamide, power mesh, and nylon. Such material may be configured as a knit, tricot-blend, textured jacquard knit, or rib-knit material as desired or needed depending on particular activity and/or comfort needs of the wearer.

In some embodiments, an additional lining may be secured to all or some part of the inside of the bottom portion 100 to provide additional structure and smoothing as needed or desired. The lining may be a power mesh lining, which may be particularly beneficial when deployed with the modesty-preserving bottoms as it is a stable, washable material that does not shift significantly when worn.

Likewise, and with attention to FIG. 4 in particular, a breathable and/or moisture wicking gusset 114 may be secured over the modesty panel 112. That is, it is contemplated that the modesty panel 112 may be immovably secured between the inside of the bottom portion 100 and the gusset 112. Immovably securing the modesty panel 112 in this manner may improve comfort and indeed beneficially avoid any discomfort and inconvenience from having to adjust a shifting modesty panel 112.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the particular fashion cut and styling of the modesty-preserving bottoms can vary depending on wearers' tastes and needs. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the modesty-preserving bottoms with which that terminology is associated. In general, the terms used in the following claims should not be constructed to limit the modesty-preserving bottoms to the specific embodiments disclosed in the specification unless the above description section explicitly define such terms. Accordingly, the actual scope encompasses not only the disclosed embodiments, but also all equivalent ways of practicing or implementing the disclosed system, method and apparatus. The above description of embodiments of the modesty-preserving bottoms is not intended to be exhaustive or limited to the precise form disclosed above or to a particular field of usage.

While specific embodiments of, and examples for, the bottoms are described above for illustrative purposes, various equivalent modifications are possible for which those skilled in the relevant art will recognize.

While certain aspects of the bottoms disclosed are presented below in particular claim forms, various aspects of such bottoms are contemplated in any number of claim forms. Thus, the inventor reserves the right to add additional claims after filing the application to pursue such additional claim forms for other aspects of the modesty-preserving bottoms.

What is claimed is:

1. Activewear, comprising:

a garment selected from the group consisting of a brief, bikini, shorts, leggings, one-piece bathing suit, leotard or unitard, such garment comprising a form-fitting bottom portion having an inside and an outside and defining a first opening and a second opening on either side of a crotch portion, each opening configured to receive one each of a wearer's legs therethrough; and a shape-retentive, concave, molded, polyfoam modesty panel formed to approximate the general curve of a wearer's pubic region and immovably fixed to an inside of the crotch portion and comprising a front end configured to cover a portion of the wearer's mons pubis and a rear end, wider than the front end, configured to cover a portion of the wearer's perineum;

wherein the modesty panel is operative to conceal at least a lower portion of the wearer's mons and at least a portion of the wearer's perineum and to smooth the crotch portion of form-fitting bottom portion over the contours of a wearer's genital area.

2. The activewear of claim 1, wherein the brief, bikini, shorts, leggings, one-piece bathing suit, leotard or unitard comprises an outside layer of resilient, four-way stretchable material selected from the group consisting of water-resistant elastane, polyester, polyamide, power mesh, and nylon.

3. The activewear of claim 2, wherein the brief, bikini, shorts, leggings, one-piece bathing suit, leotard or unitard comprise an outside layer of knit, tricot-blend, textured jacquard knit, or rib-knit material.

4. The activewear of claim 1, wherein a gusset having moisture wicking properties is disposed on an inside of the bottom portion over the modesty panel.

5. The activewear of claim 1, further comprising a power mesh lining disposed on an inside of the bottom portion such that the modesty panel is secured between such lining and form-fitting bottom.

6. The activewear of claim 1, wherein the brief, bikini, shorts, leggings, one-piece bathing suit, leotard or unitard comprises a swimsuit.

7. A woman's modesty-preserving garment, comprising:

a form-fitting swimsuit comprising a bottom portion having an inside and an outside and defining a first opening and a second opening on either side of a crotch portion, each opening configured to receive one each of a wearer's legs therethrough; and a shape-retentive, concave, molded and padded modesty panel comprising a front end configured to cover a portion of the wearer's mons pubis and a rear end, wider than the front end, configured to cover a portion of the wearer's perineum, such modesty panel formed to approximate the general curve of a wearer's pubic region and immovably fixed along an inside of the crotch portion;

wherein the modesty panel is operative to conceal at least a lower portion of the wearer's mons and at least a portion of the wearer's perineum and to smooth the form-fitting bottom portion over the contours of a wearer's genital area.

8. The garment of claim 7, wherein the modesty panel comprises material selected from the group consisting of flexible polyfoam, latex foam, silicone.

9. The garment of claim 7, wherein an outer layer of the garment comprises water-resistant, resilient, four-way stretchable fabric selected from the group consisting of elastane, polyester, polyamide, power mesh, and nylon.

10. The garment of claim 7, further comprising an inner lining secured inside the bottom portion.

11. The garment of claim 10, wherein the modesty panel is immovably secured to the bottom portion between the inner lining and an outside layer of the bottom portion.

12. The garment of claim 7, further comprising a gusset having moisture wicking properties secured inside the bottom portion over the modesty panel.

13. The garment of claim 7, wherein the bottom portion comprises a standalone brief or bikini bottom, shorts, or leggings.

* * * * *